United States Patent [19]

Sola

[11] Patent Number: 4,811,782

[45] Date of Patent: Mar. 14, 1989

[54] PROCESS FOR THE INTRODUCTION OF CHEMICAL-METAL ELEMENTS IN METAL FOUNDINGS

[75] Inventor: Giuseppe Sola, Modena, Italy

[73] Assignee: NECCHI Societa per Azioni, Pavia, Italy

[21] Appl. No.: 153,461

[22] Filed: Feb. 4, 1988

Related U.S. Application Data

[63] Continuation of Ser. No. 22,627, Mar. 5, 1987, abandoned.

[30] Foreign Application Priority Data

Apr. 22, 1986 [IT] Italy ..... 42908 A/86

[51] Int. Cl.[4] ..... B22D 27/00; B22D 27/02

[52] U.S. Cl. ..... 164/495; 164/57.1; 164/66.1

[58] Field of Search ..... 164/469, 470, 495, 496, 164/508, 514, 57.1, 58.1, 66.1

[56] References Cited

U.S. PATENT DOCUMENTS

| | | | |
|---|---|---|---|
| 3,342,250 | 9/1967 | Treppschuh et al. | 164/469 |
| 3,894,573 | 7/1975 | Paton | 164/469 |
| 4,286,646 | 9/1981 | Beyer | 164/57.1 |

FOREIGN PATENT DOCUMENTS

| | | | |
|---|---|---|---|
| 53-14604 | 2/1978 | Japan | 164/57.1 |
| 58-100951 | 6/1983 | Japan | 164/495 |
| 257533 | 6/1978 | U.S.S.R. | 164/495 |
| 1510909 | 5/1978 | United Kingdom | 164/514 |

*Primary Examiner*—Kuang Y. Lin

*Attorney, Agent, or Firm*—Stevens, Davis, Miller & Mosher

[57] ABSTRACT

A process for the introduction of metal elements in a plasma-state into metal melts where the additive element is brought to the plasma state and, by means of an inert carrying gas, is caused to spread in the fluid mass of the metal melt. The additive element is brought to the plasma state by using an electric arc.

4 Claims, 1 Drawing Sheet

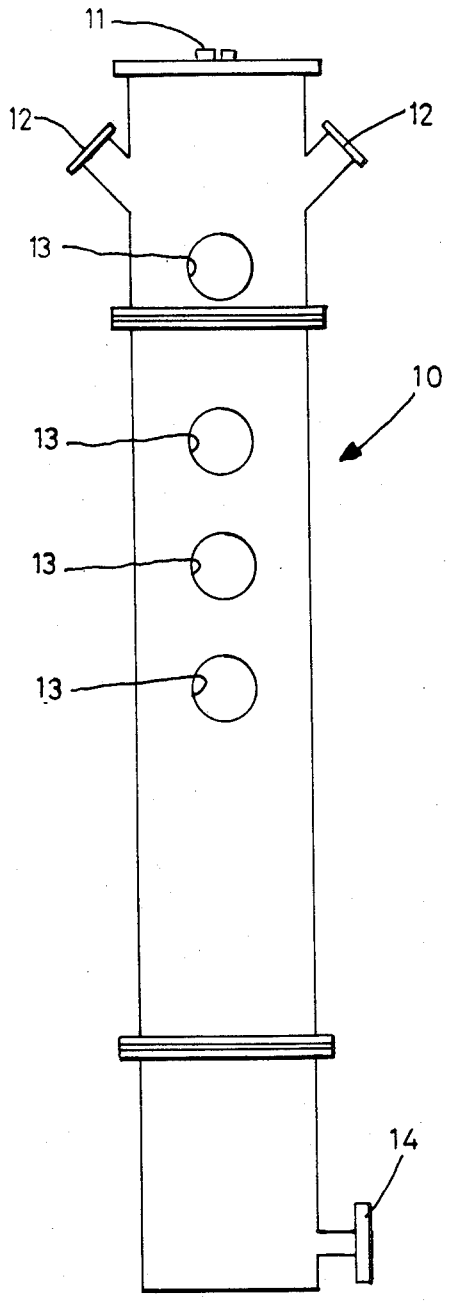
11
12
12
13
10
13
13
13
14

PROCESS FOR THE INTRODUCTION OF CHEMICAL-METAL ELEMENTS IN METAL FOUNDINGS

This application is a continuation of application Ser. No. 022,627, filed Mar. 5, 1987, and now abandoned.

BACKGROUND DISCLOSURE OF THE INVENTION

The present invention relates to a process for the introduction of a plasma-state metal elements into a metal melt or molten casting, particularly cast irons and steels.

The introduction of magnesium in the technology of manufacturing cast iron has three principal aims:

1. to spheroidize graphite;
2. to desulfurize the cast iron molten bath; and
3. to refine the bath by removing undesirable elements.

In the field of steels, beside the desulphurization and the refining, another important application is the deoxidation and final control of the cast product.

Up to now Mg addition to the molten bath (liquid) has taken place in the solid state (either metallic Mg or a Mg bearing metallic alloy) of different size (grain, dust, wire or large size).

To date the method used of contacting the molten iron with the solid magnesium by dipping or insufflation produces a high proportion of magnesium oxide which is undesirable. The process also does not permit adequate control and regulation of the introduction of the magnesium. The operator has needed to be positioned in close proximity to the molten iron container which emits an enormous amount of heat so that it is difficult for an operator to stay close to the molten iron container for the entire process.

An object of the present invention is to overcome the above described drawbacks.

The technical problem to be solved was to find a process for the introduction of metal elements into a metal founding without the need for physical intervention by operators and which would enable the operators to control, pilot and regulate the reaction between the introduced metal and the metal founding.

SUMMARY OF THE INVENTION

The solution of the technical problem is that the metal element of introduction is brought to a plasma state and in such a state is transferred by the utilization of an inert carrying gas into the metal founding. Means are provided for bringing the metal element to the plasma state. The magnesium in the gaseous state is absorbed into the molten iron with substantially no oxygen present as it passes through the molten iron.

BRIEF DESCRIPTION OF THE DRAWINGS

Other details and features of the invention will stand out from the description given below by way of non-limitative example and with reference to the accompanying drawing.

The FIGURE shows a reactor having electrodes and an inlet and outlet for a carrier gas.

DESCRIPTION OF THE PREFERRED EMBODIMENTS

The process consists in bringing the to be introduced element to the plasma state and in such a state lets it spread into the liquid mass of the metal cast, by means of the inert gas while the inert gas passes through the metal cast.

The introduction element is brought to the plasma state by the establishing and the maintaining of an electric arc between electrodes of the to be introduced element and transferred to the bath formed by the cast by means of an inert carrying gas.

With reference to the FIGURE, the inert carrier gas, which may be for example nitrogen, is provided in a reactor 10 through the input 11 and strikes the electric arc formed by the plasma and generated by the electrodes placed in 12 and subjected to a predetermined voltage.

The metal material from which the electrodes are formed, is magnesium in the desired example. The material is vaporized by the energy produced by the electric arc according to an energy balance taking into account the transportation of matter, charge and energy from the plasma column to the electrodes and vice versa. The material, vaporized and transported by the inert gas passes longitudinally through the reactor 10 and it is observable through special holes 13.

The vaporized material exits from the reactor 10 through the outlet I4 which is connected with the column of cast metal. This is not schematized because it may be any container of various type, form and size adapted to receive the cast metal.

The electric arc, fed by alternating current, is provided with a device able to assure the automatic regulation of the distance between electrodes according to their wear.

I claim:

1. Process for the introduction of entrained plasma-state metal elements into cast iron or steel metal melt, comprising bringing portions of metal electrodes to a plasma state between said electrodes while arcing, passing an inert gas past said metal electrodes to entrain said metal in plasma state and injecting said inert carrying gas and entrained metal in plasma state into said metal melt.

2. The process according to the claim 1, including passing an alternating electric current between said electrodes spaced apart to constitute an electric arc, said electrodes, being vaporized by the energy produced by said arc.

3. The process according to the claim 1 wherein one of said electrodes is magnesium.

4. The process according to the claim 1 wherein said inert carrying gas is nitrogen.

* * * * *